US008851914B2

(12) United States Patent
Lin et al.

(10) Patent No.: US 8,851,914 B2
(45) Date of Patent: Oct. 7, 2014

(54) ELECTRICAL CONNECTOR HAVING A POSITIONING MEMBER FOR HOLDING CONDUCTING TERMINALS AND PRESS MEMBERS

(71) Applicant: Aces Electronics Co., Ltd., Jhongli (TW)

(72) Inventors: Shin-Way Lin, Jhongli (TW); Hao-Jan Tuan, Jhongli (TW); Yuan-Huang Liu, Taoyuan (TW)

(73) Assignee: Aces Electronics Co., Ltd., Jhongli (TW)

( * ) Notice: Subject to any disclaimer, the term of this patent is extended or adjusted under 35 U.S.C. 154(b) by 49 days.

(21) Appl. No.: 13/709,854

(22) Filed: Dec. 10, 2012

(65) Prior Publication Data

US 2013/0149883 A1 Jun. 13, 2013

(30) Foreign Application Priority Data

Dec. 13, 2011 (TW) ..... 100146005 A

(51) Int. Cl.

| | |
|---|---|
| ***H01R 13/62*** | (2006.01) |
| ***H01R 13/629*** | (2006.01) |
| ***H01R 12/88*** | (2011.01) |
| *H01R 12/79* | (2011.01) |

(52) U.S. Cl.

CPC ..... *H01R 13/62933* (2013.01); *H01R 12/79* (2013.01); *H01R 12/88* (2013.01)

USPC ..... 439/260

(58) Field of Classification Search

CPC .. H01R 23/668; H01R 23/684; H01R 23/688; H01R 23/6806; H01R 23/6833; H01R 13/193; H01R 13/658; H01R 12/62; H01R 12/79; H01R 12/88

See application file for complete search history.

(56) References Cited

U.S. PATENT DOCUMENTS

| | | | | |
|---|---|---|---|---|
| 8,177,571 | B2 * | 5/2012 | Yokoo et al. | 439/260 |
| 2009/0305550 | A1 * | 12/2009 | Suzuki et al. | 439/494 |
| 2010/0151716 | A1 * | 6/2010 | Suzuki et al. | 439/260 |
| 2013/0149877 | A1 * | 6/2013 | Liu | 439/61 |
| 2013/0330973 | A1 * | 12/2013 | Ashibu | 439/629 |
| 2014/0065864 | A1 * | 3/2014 | LEE et al. | 439/260 |

FOREIGN PATENT DOCUMENTS

| | | |
|---|---|---|
| TW | M304148 | 1/2007 |

* cited by examiner

*Primary Examiner* — Chandrika Prasad

(74) *Attorney, Agent, or Firm* — Muncy, Geissler, Olds & Lowe, P.C.

(57) ABSTRACT

An electrical connector includes a connector body including a holder base and positioning members mounted in respective vertical insertion slots in the holder base, conducting terminals positioned in the holder base with respective mounting portions thereof fastened to the positioning members, press members respectively fastened to the positioning members and suspending above the conducting terminals for holding down a flexible printed circuit board on front contact portions of the conducting terminals, and a swivel cover coupled to the holder base and the press members and biasable relative to the holder base and the press member between a horizontal close position and a vertical open position.

9 Claims, 9 Drawing Sheets

ELECTRICAL CONNECTOR HAVING A POSITIONING MEMBER FOR HOLDING CONDUCTING TERMINALS AND PRESS MEMBERS

This application claims the priority benefit of Taiwan patent application number 100146005, filed on Dec. 13, 2011.

BACKGROUND OF THE INVENTION

1. Field of the Invention

The present invention relates to electrical connector technology and more particularly, to an electrical connector for flexible printed circuit board application, which effectively reduces high frequency interference.

2. Description of the Related Art

Following fast development of computer, network and electronic information technologies, various advanced electronic devices and systems are well developed and widely used for different applications. Further, it is the market trend to create electronic devices having light, thin, short and small characteristics. In consequence, circuit board electronic components must be made extremely strong, small and precise. Further, many different electrical connectors may be used in an electronic apparatus to connect different components and parts to a circuit board for signal transmission. Designing an electrical connector for signal transmission must consider the factors of signal transmission capacity and body size miniaturization. Electrical connectors for FPC (Flexible Printed Circuit) application are then created. Electrical connectors for FPC application have the characteristics of a large number of conducting terminals and low profile. These electrical connectors are intensively used in computers and related peripheral equipment for high frequency signal transmission. However, because these electrical connectors have a high pin count, interferences (statistical interference, electromagnetic interference, impedance matching, noise interference, cross-talk interference) may occur during transmission of a high frequency signal if the pins (conducting terminals) are curved.

Taiwan Patent Number: M304148 discloses an electrical connector entitled "Electrical Connector for Flexible Printed Circuit Board". According to this design, as shown in FIGS. 7-9, a press member C is inserted into a front opening A1 of a housing A to let top arms B1 and bottom contact portions B2 of respective conducting terminals B be engaged into respective notches C3 of the press member C and positioned in the bottom side of the front opening A1 of the housing A respectively. At this time, rear bonding portions B3 of the conducting terminals B suspend outside the housing A for bonding to an external mainboard, and respective positioning points C4 in the notches C3 of the press member C are respectively positioned in respective bottom grooves B11 of the top arms B1 of respective conducting terminals B. Thereafter, support members D are respectively inserted into respective mounting portions A2 of the housing A to support respective support arms C2 of the press member C, holding down the positioning points C4 of the press member C in the bottom grooves B11 of the respective conducting terminals B. At this time, press portions C5 of the press member C are kept between the top arms B1 and bottom contact portions B2 of the conducting terminals B. Thus, the press member C can be turned relative to the housing A between an open position and a close position and will not fall out of the housing A.

When connecting the electrical connector to a flexible printed circuit board E, attach the support arms C2 of the press member C to the respective support members D, and then move an operating portion C1 of the press member C to bias smoothly arched surfaces C21 of the support arms C2 relative to the respective support members D from horizontal to vertical while keeping the positioning points C4 of the press member C in the bottom grooves B11 of the respective conducting terminals B, and then insert the flexible printed circuit board E into the gap between the top arms B1 and bottom contact portions B2 of the conducting terminals B, and then turn the press member C backwardly from vertical to horizontal to force the press portions C5 of the press member C against the flexible printed circuit board E, enabling the flexible printed circuit board E to be clamped between the press portions C5 of the press member C and respective protrusions B21 of the bottom contact portions B2 of the conducting terminals B. Thus, the flexible printed circuit board E and the conducting terminals B are electrically conducted. Subject to the design of the smoothly arched surfaces C21 of the support arms C2, the press member C can be smoothly biased relative to the respective support members D between the horizontal close position and the vertical open position. Further, by means of using the support members D to support the support arms C2 of the press member C, the positioning points C4 of the press member C are positively kept in the bottom grooves B11 of the respective conducting terminals B.

However, according to the aforesaid prior art design, the conducting terminals B have a roughly C-shaped profile where the top arms B1 respectively extend from the respective bottom contact portions B2 of the conducting terminals B without contacting the flexible printed circuit board E. During application, high frequency signal is transmitted through the flexible printed circuit board E and the bottom contact portions B2 and bonding portions B3 of the conducting terminals B to the mainboard. The branched top arms B1 tend to cause a skin effect, limiting the cross-sectional conducting terminal area available to carry alternating current, increasing the resistance of the conducting terminals above the normal resistance for direct current. In consequence, signal transmission bandwidth and quality may not reach the designed standards, affecting normal functioning of the electronic device (computer or network equipment).

Therefore, it is desirable to provide an electrical connector for high frequency application that eliminates the aforesaid problems.

SUMMARY OF THE INVENTION

The present invention has been accomplished under the circumstances in view. It is therefore the main object of the present invention to provide an electrical connector, which is practical for use with a flexible printed circuit board for high frequency application, facilitates installation and effectively reduces noises during application.

To achieve this and other objects of the present invention, an electrical connector comprises a connector body comprising a holder base and positioning members mounted in respective vertical insertion slots in the holder base, conducting terminals positioned in the holder base with respective mounting portions thereof fastened to the positioning members, press members respectively fastened to the positioning members and suspending above the conducting terminals for holding down a flexible printed circuit board on front contact portions of the conducting terminals, and a swivel cover coupled to the holder base and the press members and biasable relative to the holder base and the press member between a horizontal close position and a vertical open position.

Using the positioning members to hold the conducting terminals and the press members in place eliminates the problem of skin effect and enables the swivel cover to be turned smoothly between the horizontal close position and the vertical open position without imparting much pressure to the press members and the flexible printed circuit board, and therefore the electrical connector avoids noise generation and statistic interference and damage to the upright base frames of the holder base of the connector body.

Further, the positioning members are molded on the mounting portions of the conducting terminals and the mounting portions of the press members by insert molding.

DETAILED DESCRIPTION OF THE PREFERRED EMBODIMENT

Figure 1:
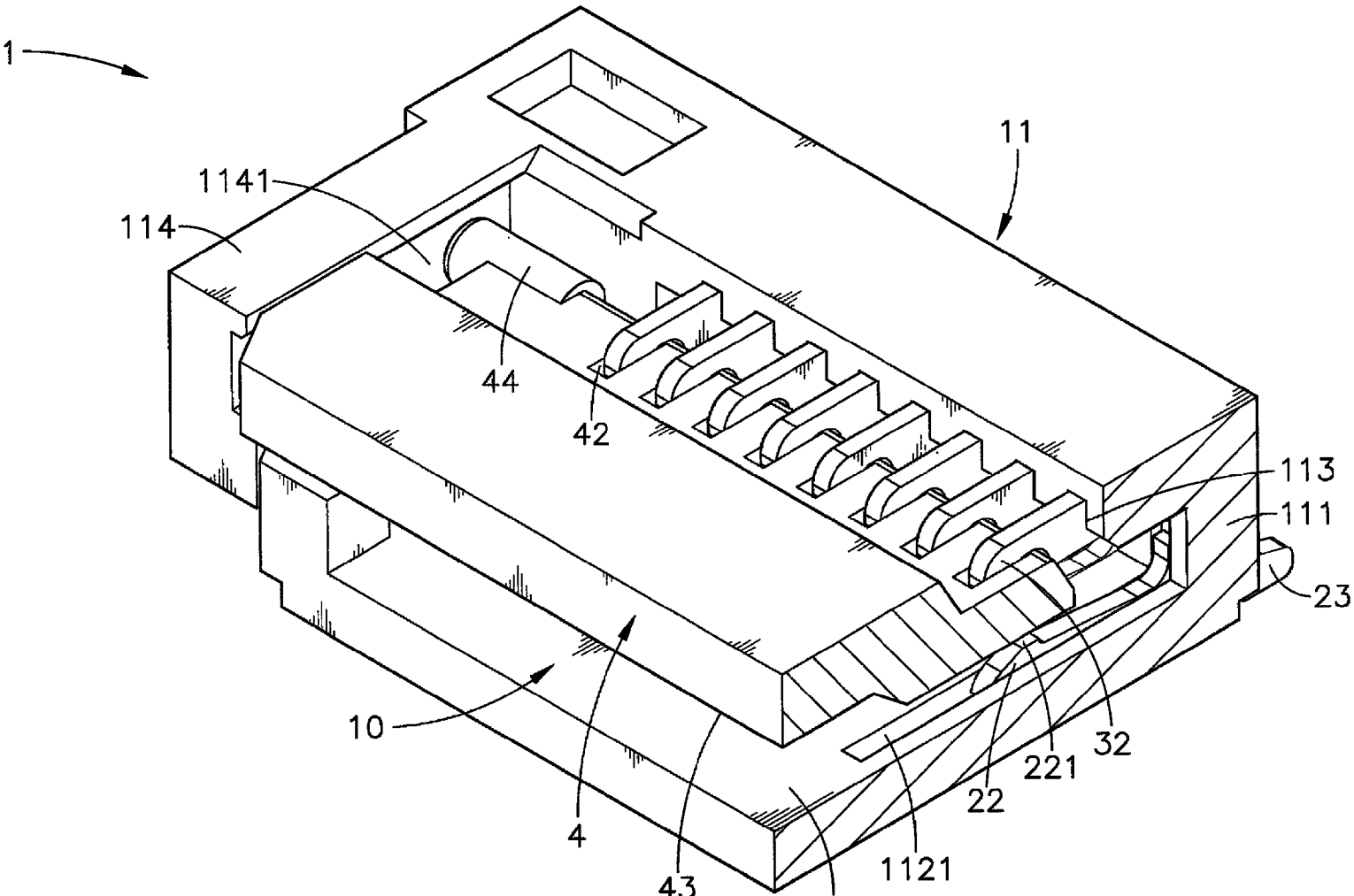
FIG. 1 is an oblique top partial elevational view of an electrical connector in accordance with the present invention.
Figure 2:
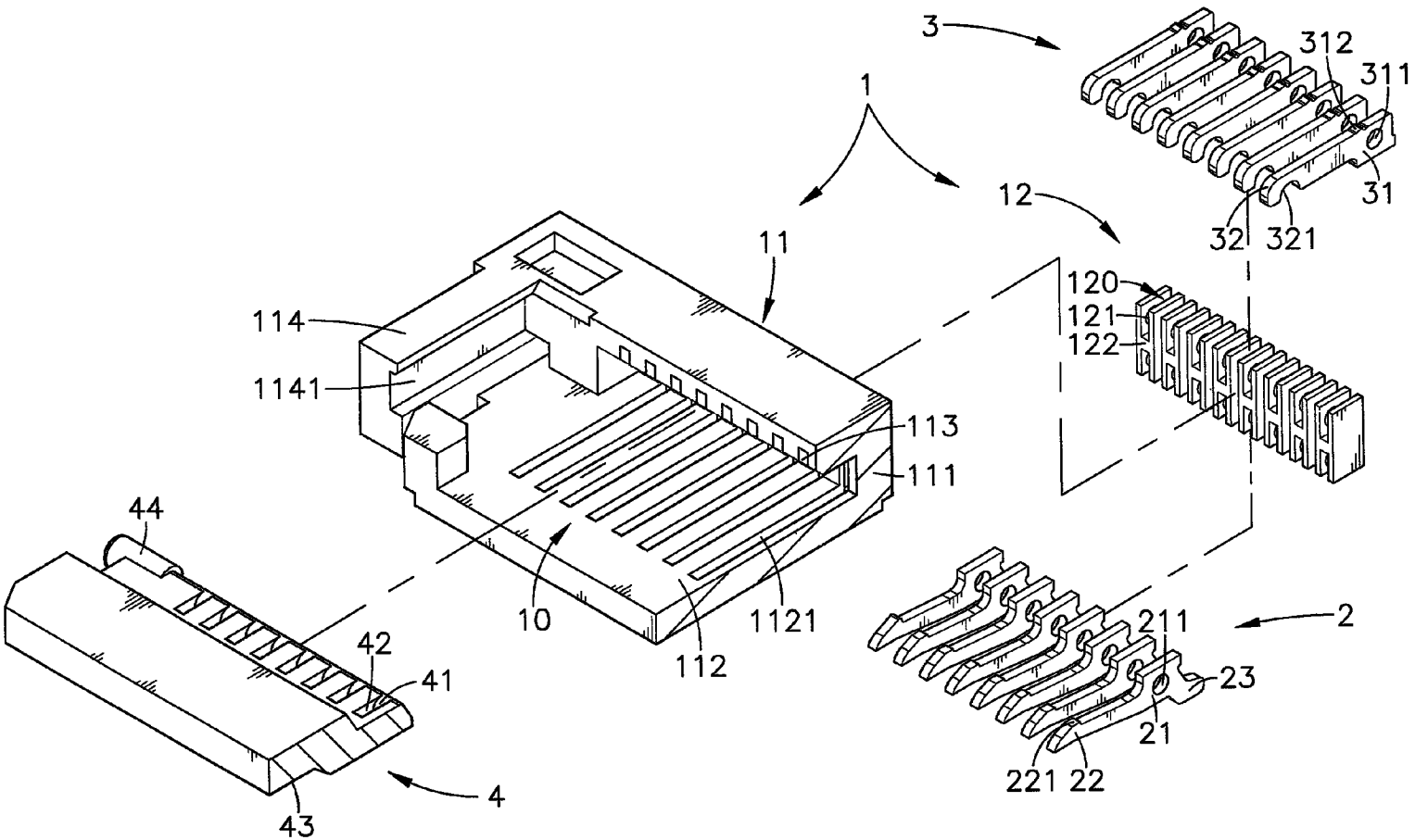
FIG. 2 is a partial exploded view of the electrical connector in accordance with the present invention.
Figure 3:
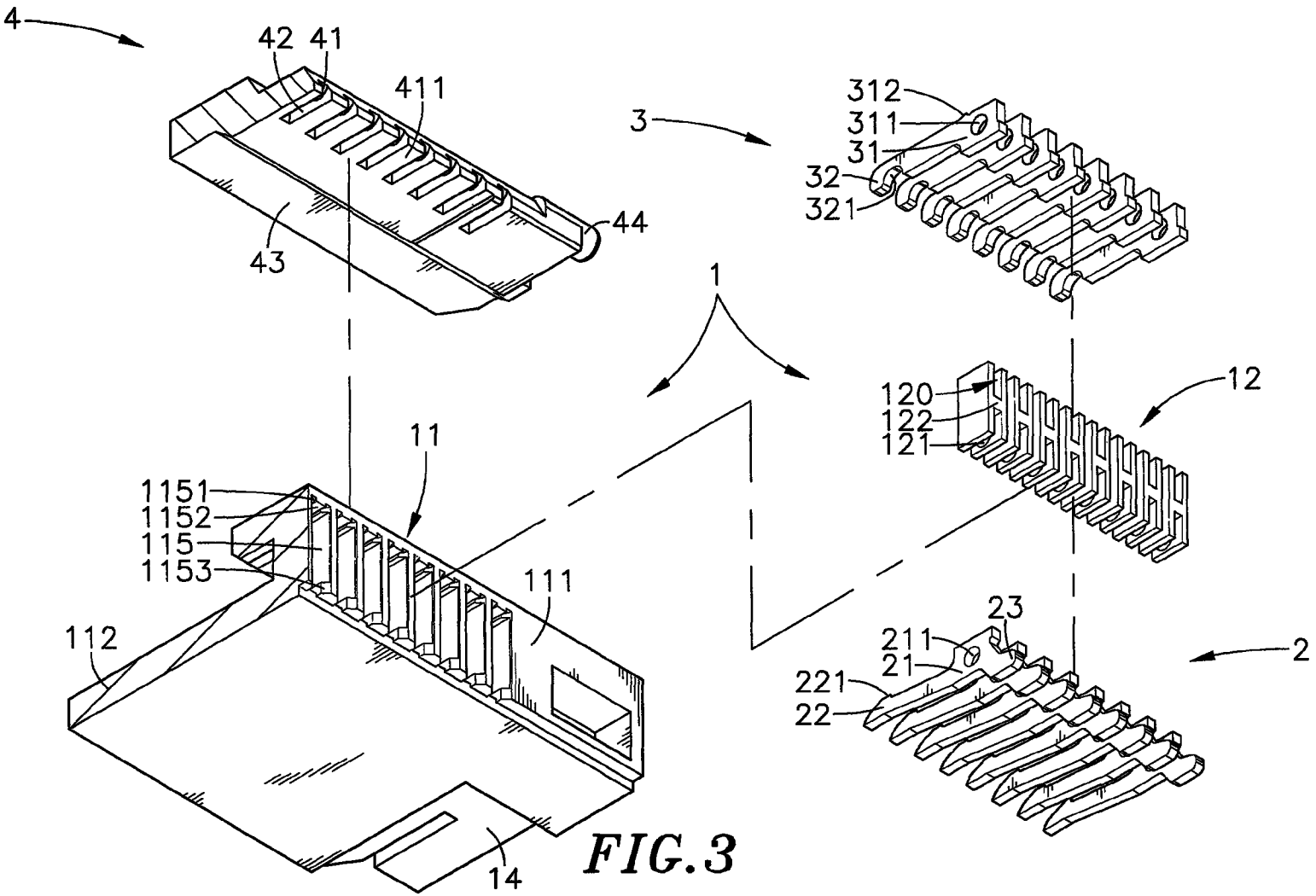
FIG. 3 corresponds to FIG. 2 when viewed from another angle.
Figure 4:
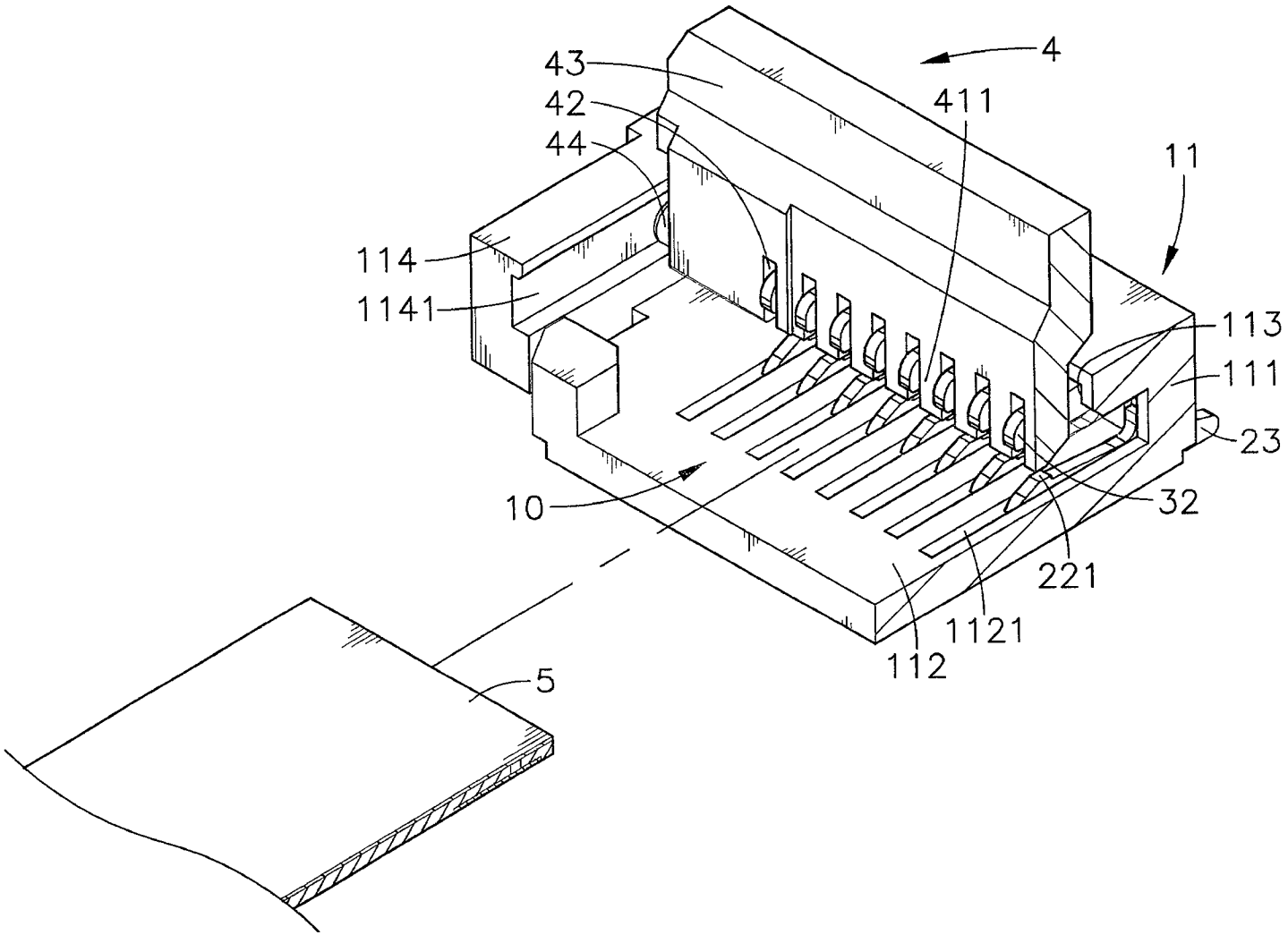
FIG. 4 is a partial schematic elevational applied view of the present invention, illustrating the swivel cover lifted to the vertical open position before insertion of a flexible printed circuit board.

Referring to FIGS. 1, 2, 3 and 4, a part of an electrical connector in accordance with the present invention is shown. The electrical connector comprises a connector body 1, a set of conducting terminals 2, a set of press members 3, and a swivel cover 4.

The connector body 1 comprises a holder base 11, and a plurality of positioning members 12. The holder base 11 comprises an upright base frame 111, a horizontal bottom panel 112 forwardly extended from the bottom side of the upright base frame 11, an accommodation open chamber 10 surrounded by the upright base frame 111 and the horizontal bottom panel 112, a plurality of vertical insertion slots 115 cut through opposing front and back sides of the upright base frame 111, a plurality of openings 113 located at the front side of the upright base frame 111 near its top side and respectively disposed in communication with the vertical insertion slots 115, two elongated ribs 1152 respectively located on the opposing top and bottom walls of each of the vertical insertion slots 115 and extending in direction toward the accommodation open chamber 10, two sliding ways 1151 defined in each of the opposing top and bottom walls of each of the vertical insertion slots 115 at two opposite lateral sides relative to the respective elongated rib 1152, a plurality of beveled guide surface 1153 respectively located at opposing lateral sidewalls of each of the vertical insertion slots 115 and abutted to the respective sliding ways 1151, a plurality of terminal grooves 1121 located at the top wall of the horizontal bottom panel 112 and respectively forwardly extended from the respective bottom ends of the vertical insertion slots 115, two horizontal shafts 114 respectively forwardly extended from the base frame 111 at two opposite lateral sides relative to the horizontal bottom panel 112, and a sliding groove 1141 located at an inner side of each of the two horizontal shafts 114 and facing toward the accommodation open chamber 10. The positioning members 12 are respectively mounted in the vertical insertion slots 115, each comprising a horizontal partition plate 122, opposing top and bottom open chambers 120 symmetrically defined at opposing top and bottom sides relative to the horizontal partition plate 122, and two locating rods 121 respectively disposed in the open chambers 120. Further, the positioning members 12 can be made of an electrically insulative plastic material.

The conducting terminals 2 each comprise a mounting portion 21, a through hole 211 cut through opposing left and right of the mounting portion 21, a front contact portion 22 forwardly extended from the mounting portion 21 and positioned in one respective terminal groove 1121 of the horizontal bottom panel 112 of the holder base 11 of the connector body 1, a protrusion 221 located at a front top side of the front contact portion 22, and a rear bonding portion 23 backwardly extended from the mounting portion 21 and inserted through one respective vertical insertion slot 115 to the outside of the upright base frame 111 of the holder base 11 of the connector body 1.

The press members 3 each comprise a mounting portion 31 mountable in one respective vertical insertion slot 115 of the holder base 11 of the connector body 1, a through hole 311 cut through opposing left and right sides of the mounting portion 31, a friction portion 312 raised from the top side of the mounting portion 31 and forced into friction engagement with the peripheral wall of the respective vertical insertion slot 115 of the holder base 11 of the connector body 1, a front pressure arm 32 forwardly extended from the mounting portion 31, and a smoothly arched locating notch 321 located at a front bottom side of the front pressure arm 32. Further, the press members 3 can be selectively made out of a metal or plastic material.

The swivel cover 4 comprises a front base panel 411, a plurality of elongated slots 42 cut through opposing top and bottom sides of the front base panel 411 in a parallel manner, a plurality of axles 41 respectively and transversely disposed in a front side of each of the elongated slots 42 and axially aligned in line, and an operating portion 43 backwardly extended from the front base panel 41, and two pivot rods 44 respectively extended from two opposite lateral sides of the front base panel 41.

Figure 5:
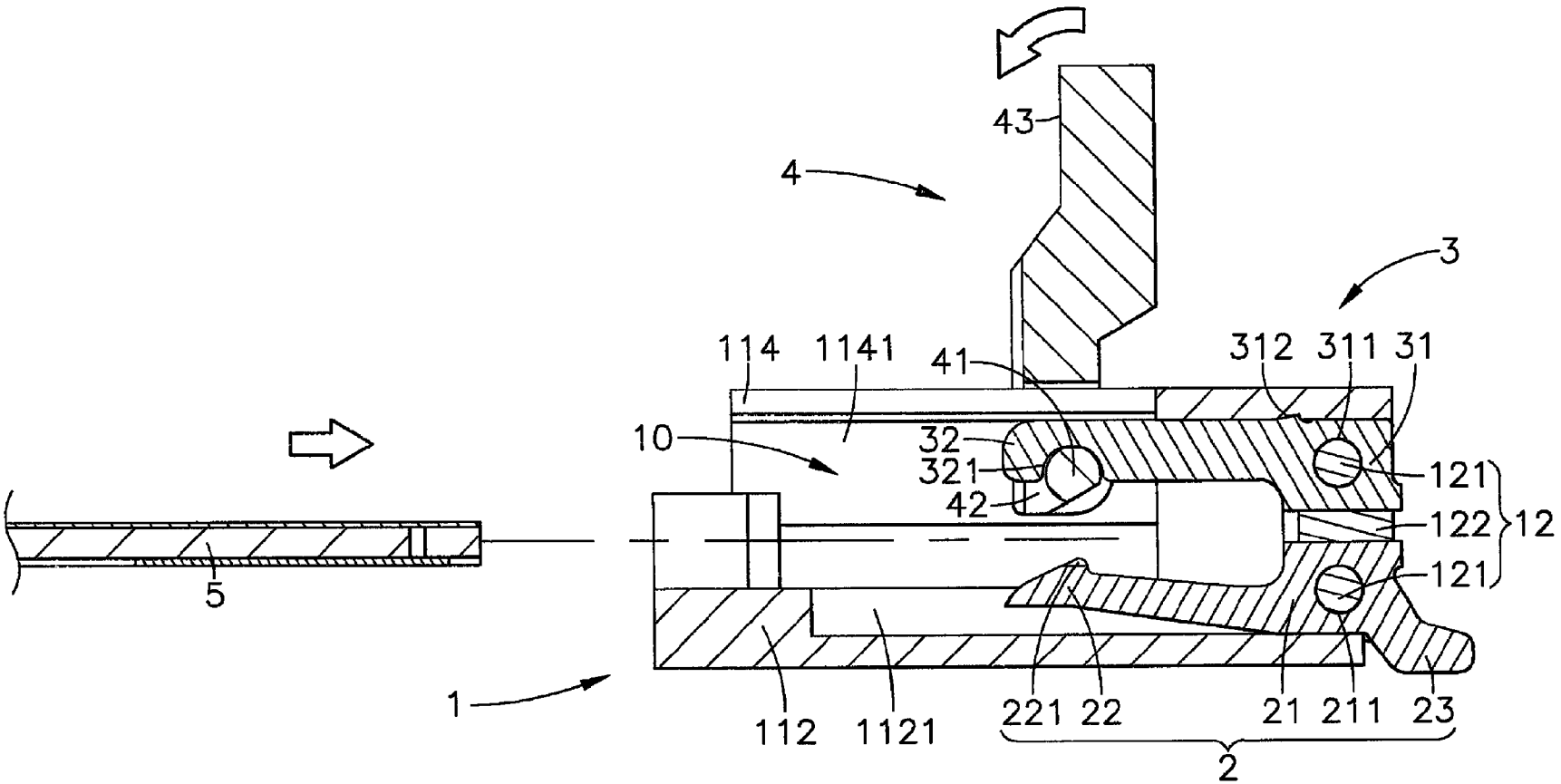
FIG. 5 is a sectional side view of FIG. 4.
Figure 6:
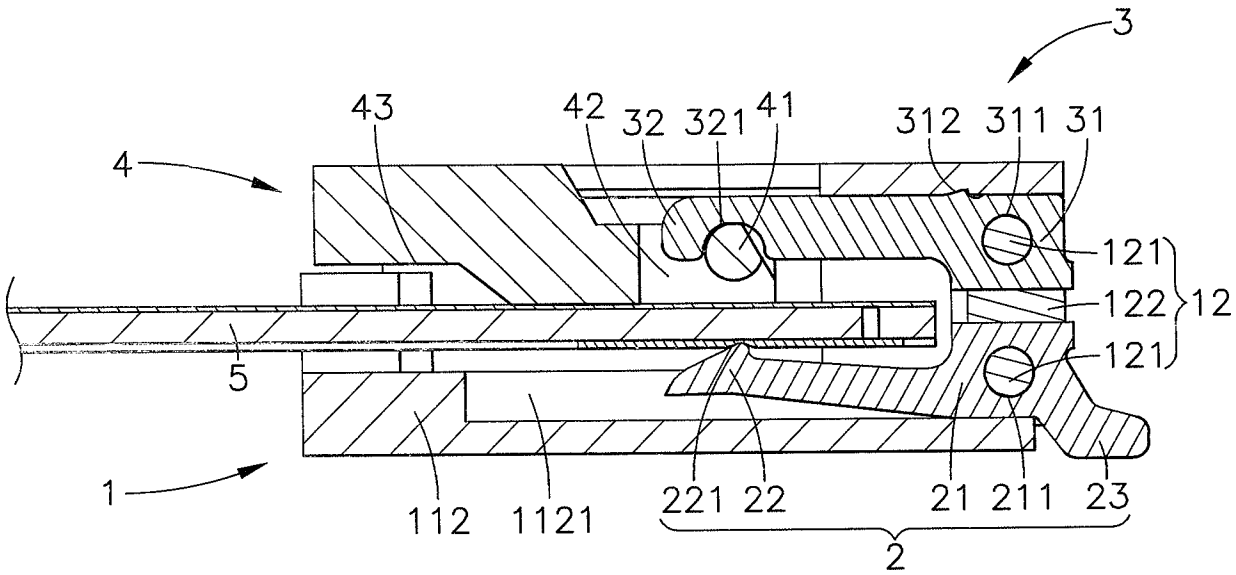
FIG. 6 corresponds to FIG. 5, illustrating the flexible printed circuit board inserted into the accommodation open chamber of the holder base of the connector body and the swivel cover closed.
Figure 7:
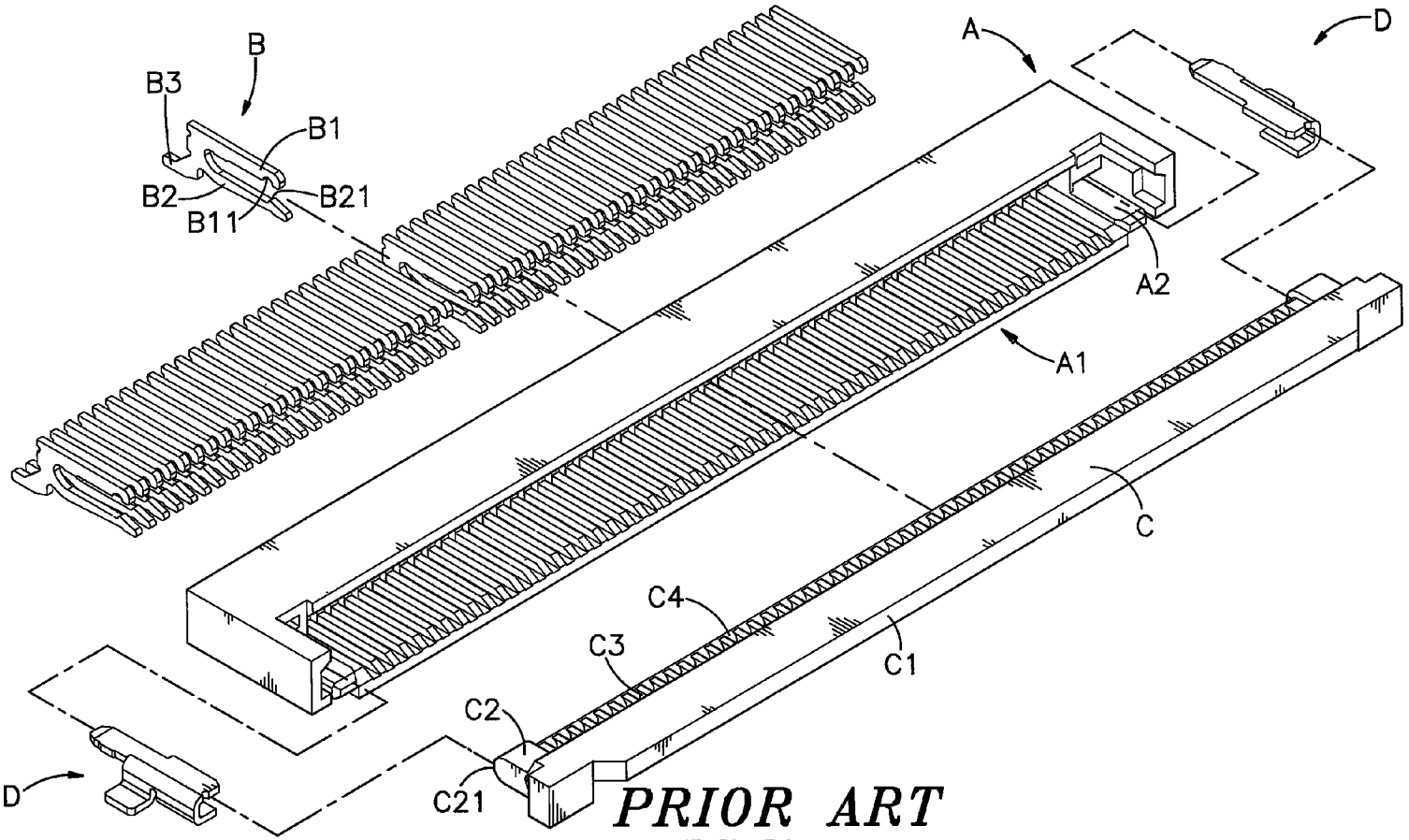
PRIOR ART FIG.7
FIG. 7 is an exploded view of an electrical connector according to the prior art.
Figure 8:
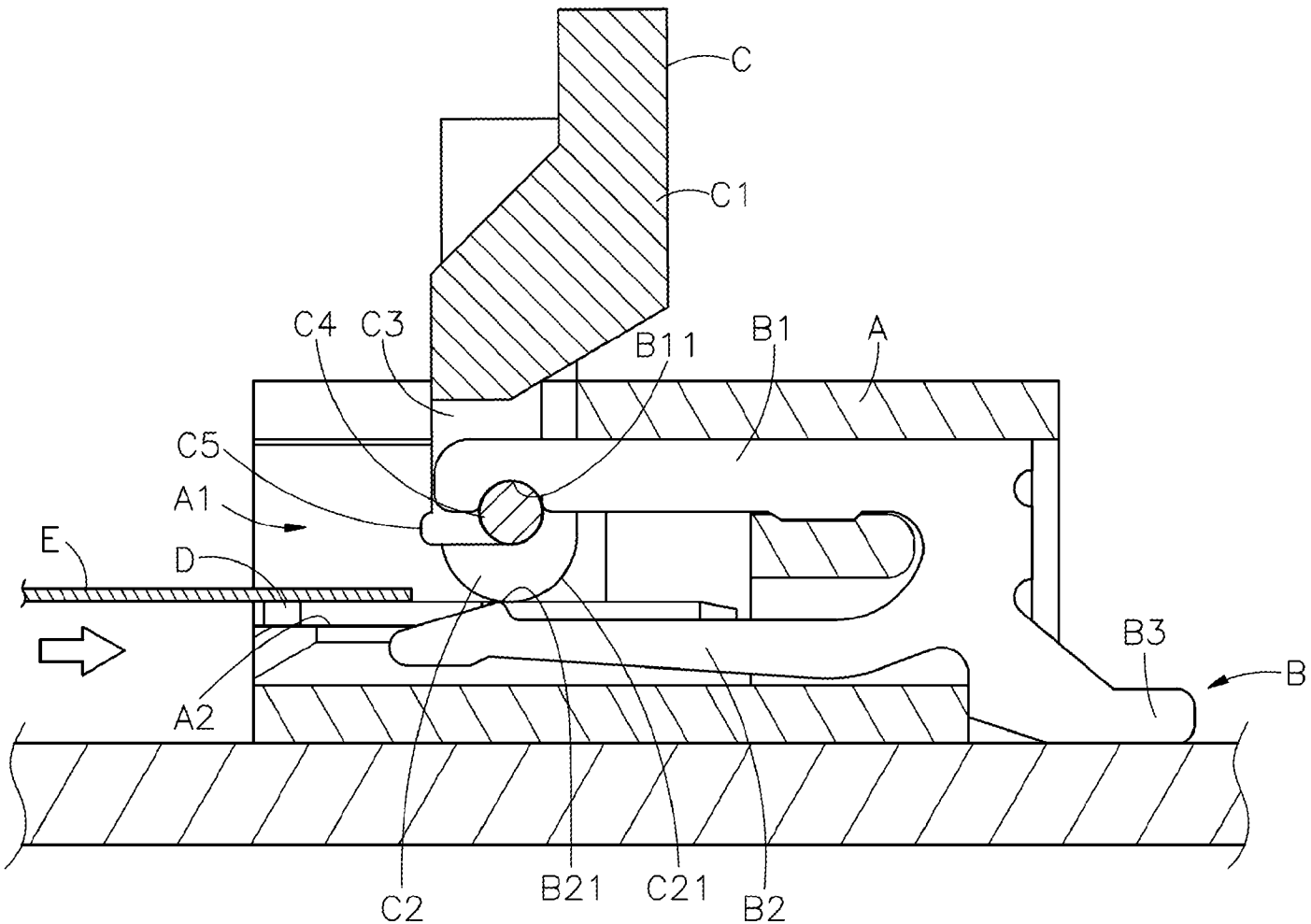
PRIOR ART FIG. 8
FIG. 8 is a sectional side view of the prior art electrical connector, illustrating the press member opened and a flexible printed circuit board partially inserted into the front opening of the housing.
Figure 9:
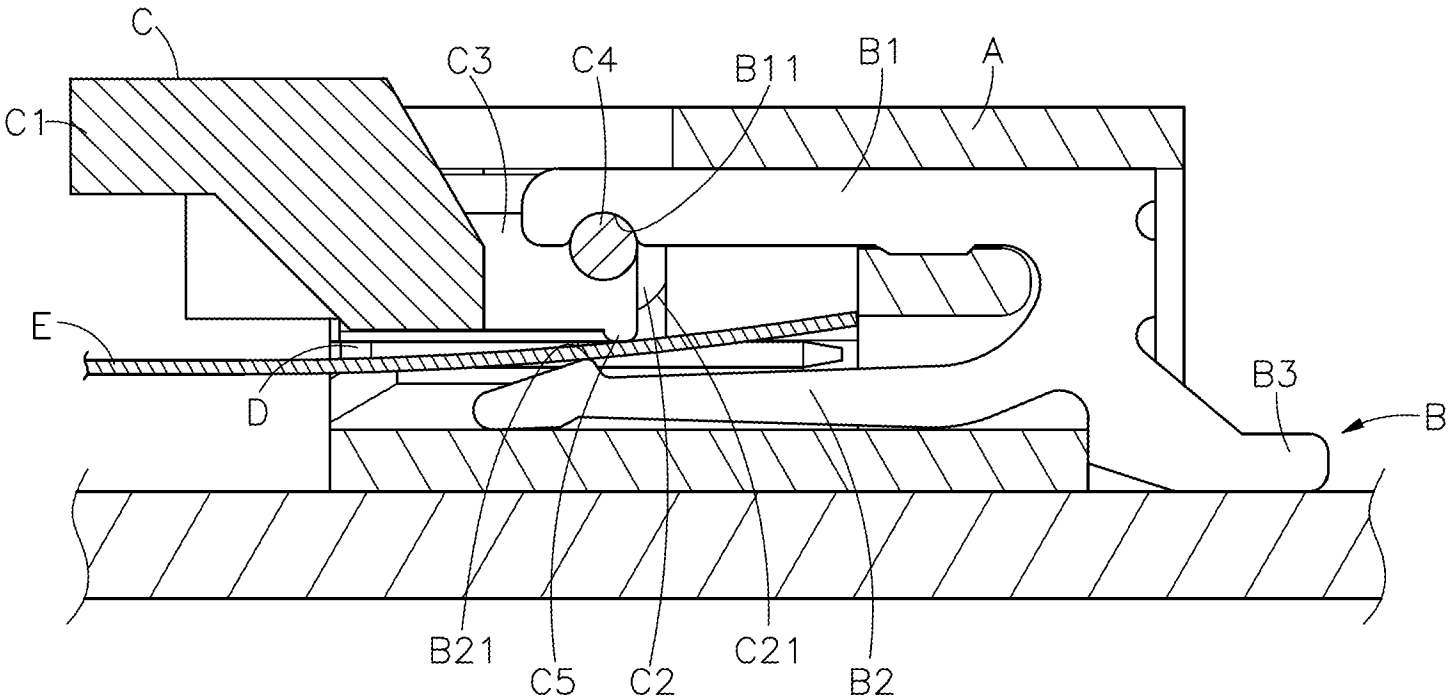
PRIOR ART FIG. 9
FIG. 9 corresponds to FIG. 8, illustrating the printed circuit board installed and the press member closed.

Referring to FIGS. 5 and 6 and FIG. 4 again, when assembling the electrical connector, couple the through holes 211 of the mounting portion 21 of the conducting terminals 2 and the through holes 311 of the mounting portion 31 of the press members 3 to the locating rods 121 in the top and bottom open chambers 120 of the positioning members 12 to let the respective top edges of the mounting portions 21 of the conducting terminals 2 and the respective bottom edges of the mounting portions 31 of the press members 3 be respectively stopped against the opposing top and bottom sides of the horizontal partition plates 122 of the positioning members 12, and then insert the front contact portions 22 of the conducting terminals 2 and the front pressure arm 32 of the press members 3 with the positioning members 12 into the respective vertical insertion slots 115 of the holder base 11 of the connector body 1 to let the front contact portions 22 of the conducting terminals 2 be respectively positioned in the terminal groove 1121 of the horizontal bottom panel 112 of the holder base 11 of the connector body 1 and the front pressure arm 32 of the press members 3 suspend in the accommodation open chamber 10 of the connector body 1. By means of the beveled guide surfaces 1153, the positioning members 12 can be smoothly guided into the respective sliding ways 1151 of the holder base 11 of the connector body 1 in the respective vertical insertion slots 115. At this time, the friction portions 312 of the press members 3 are respectively forced into friction engagement with the peripheral walls of the respective vertical insertion slots 115. Thereafter, insert the swivel cover 4 into the accommodation open chamber 10 of the holder base 11 of the connector body 1 to couple the two pivot rods 44 of the swivel cover 4 to the respective sliding grooves 1141 at the two horizontal shafts 114 of the holder base 11 of the connector body 1 and to have the smoothly arched locating notches 321 of the press members 3 be respectively coupled to the axles 41 of the swivel cover 4 in the respective elongated slots 42. Thus, the swivel cover 4 can be turned up and down relative to the holder base 11 of the connector body 1 within a predetermined angle, for example, 90° angle.

According to the present preferred embodiment, the conducting terminals 2, the press members 3 and the positioning members 12 are separately made and then assembled together and then mounted in the holder base 11 of the connector body 1. Alternatively, each positioning member 12 can be molded on the mounting portion 21 of one respective conducting terminal 2 and the mounting portion 31 of one respective press member 3 by insert molding.

Referring to FIGS. 1 and 4-6 again, when installing a flexible printed circuit board 5 in the electrical connector, move the operating portion 43 to turn the swivel cover 4 relative to the holder base 11 of the connector body 1 from a horizontal close position shown in FIG. 1 to a vertical open position shown in FIG. 4, and then insert the flexible printed circuit board 5 into the accommodation open chamber 10 of the holder base 11 of the connector body 1 above the front contact portion 22 of the conducting terminals 2, and then turn the swivel cover 4 from the vertical open position back to the horizontal close position to press the bottom wall of the front base panel 411 of the swivel cover 4 on the flexible printed circuit board 5, enabling the flexible printed circuit board 5 to be sandwiched between the front base panel 411 of the swivel cover 4 and the protrusions 221 at the front contact portions 22 of the conducting terminals 2. Thus, the conducting terminals 2 and the flexible printed circuit board 5 are electrically conducted.

According to the present invention, the separated design of the conducting terminals 2 and the press members 3 eliminates the problem of skin effect as seen in the prior art design, avoiding noise generation and statistic interference. Further, the use of the positioning members 12 to couple the mounting portions 21 of the respective conducting terminals 2 and the mounting portions 31 of the respective press members 3 enables the swivel cover 4 to be turned smoothly between the horizontal close position and the vertical open position without imparting much pressure to the press members 3 and the flexible printed circuit board 5, avoiding damage to the upright base frame 111 of the holder base 11 of the connector body 1 and the peripheral walls of the vertical insertion slots 115. Further, this coupling design also facilitates installation.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. An electrical connector, comprising:

a connector body comprising a holder base, said holder base comprising an upright base frame, a horizontal bottom panel forwardly extended from a bottom side of said base frame, an accommodation open chamber surrounded by said upright base frame and said horizontal bottom panel and a plurality of vertical insertion slots cut through opposing front and back sides of said upright base frame, and a plurality of positioning members respectively mounted in said vertical insertion slots of said holder base;

a plurality of conducting terminals respectively fastened to said positioning members in said vertical insertion slots of said holder base and positioned on said horizontal bottom panel in said accommodation open chamber, each said conducting terminal comprising a mounting portion fastened to one said positioning member, a front contact portion forwardly extended from the mounting portion of the respective conducting terminal and positioned on said horizontal bottom panel of said holder base of said connector body and a rear bonding portion backwardly extended from the mounting portion of the respective conducting terminal and suspending outside of said upright base frame of said holder base of said connector body;

a plurality of press members respectively fastened to said positioning members above said conducting terminals, each said press member comprising a mounting portion fastened to one said positioning member, a front pressure arm forwardly extended from the mounting portion of the respective press member and a smoothly arched locating notch located at a front bottom side of said front pressure arm; and a swivel cover coupled to said holder base of said connector body and said press members and biasable relative to said holder base and said press member between a horizontal close position and a vertical open position, said swivel cover comprising a front base panel, a plurality of elongated slots cut through opposing top and bottom sides of said front base panel in a parallel manner and respectively coupled to said front pressure arms of said press members and a plurality of axles respectively and transversely disposed in a front side of each of said elongated slots and respectively coupled to the smoothly arched locating notches of said press members.

2. The electrical connector as claimed in claim 1, wherein said press members are selected from the material group of metal and plastics.

3. The electrical connector as claimed in claim 1, wherein each said press member further comprises a friction portion raised from a top side of the mounting portion thereof and forced into friction engagement with a peripheral wall of the respective vertical insertion slot of said holder base of said connector body.

4. The electrical connector as claimed in claim 1, wherein each said conducting terminal further comprises a through hole cut through opposing left and right sides of the mounting portion thereof; each said press member further comprises a through hole cut through opposing left and right sides of the mounting portion thereof; each said positioning member comprises a horizontal partition plate, opposing top and bottom open chambers symmetrically defined at opposing top and bottom sides relative to said horizontal partition plate for receiving one said press member and one said conducting terminal, and two locating rods respectively disposed in said open chambers and respectively fastened to the through hole of one said press member and the through hole of one said conducting terminal.

5. The electrical connector as claimed in claim 4, wherein said conducting terminals have respective top sides of the respective mounting portions thereof respectively stopped against respective bottom sides of the respective horizontal partition plates of said positioning members; said press members have respective bottom sides of the respective mounting portions thereof respectively stopped against respective top sides of the respective horizontal partition plates of said positioning members.

6. The electrical connector as claimed in claim 1, wherein said positioning members are molded on the mounting portions of said conducting terminals and the mounting portions of said press members by insert molding.

7. The electrical connector as claimed in claim 1, wherein each said conducting terminal further comprises a protrusion located at a front top side of the front contact portion thereof.

8. The electrical connector as claimed in claim 1, wherein said holder base of said connector body further comprises two horizontal shafts respectively forwardly extended from said base frame at two opposite lateral sides relative to said horizontal bottom panel, and a sliding groove located at an inner side of each of said two horizontal shafts and facing toward the accommodation open chamber; said swivel cover further comprises two pivot rods respectively extended from two opposite lateral sides of said front base panel thereof and respectively coupled to the sliding grooves at said horizontal shafts of said holder base of said connector body.

9. The electrical connector as claimed in claim 1, wherein said holder base further comprises a plurality of terminal grooves located at a top wall of said horizontal bottom panel and respectively forwardly extended from respective bottom ends of said vertical insertion slots.

* * * * *